US006126713A

United States Patent [19]

Igarashi et al.

[11] Patent Number: 6,126,713

[45] Date of Patent: Oct. 3, 2000

[54] ADDITIVE FOR USE IN PRODUCING SPHEROIDAL GRAPHITE CAST IRON

[75] Inventors: Yoshio Igarashi; Hideharu Nakano; Kenya Matsuyama; Masahiro Takahashi, all of Tochigi-ken; Senri Okada, Tokyo; Masahide Kawabata, Tochigi-ken; Katsuhiko Kojo, Saitama-ken; Toshiki Yoshida, Tochigi-ken, all of Japan

[73] Assignee: Hitachi Metals, Ltd., Tokyo, Japan

[21] Appl. No.: 08/956,788

[22] Filed: Oct. 23, 1997

[30] Foreign Application Priority Data

Oct. 24, 1996 [JP] Japan ..... 8-282716
Jan. 30, 1997 [JP] Japan ..... 9-016256

[51] Int. Cl.[7] ..... C21C 1/10; C22C 37/04

[52] U.S. Cl. ..... 75/305; 75/314; 75/315; 75/316; 420/23; 420/25

[58] Field of Search ..... 75/305, 314, 315, 75/316; 420/20, 22, 23, 25, 18, 19

[56] References Cited

U.S. PATENT DOCUMENTS 4,076,522 2/1978 Yoshida ..... 420/19

FOREIGN PATENT DOCUMENTS 51-32571 9/1976 Japan ..... 420/18
54-33818 3/1979 Japan ..... 420/23
54-115612 9/1979 Japan .
54-124814 9/1979 Japan .

OTHER PUBLICATIONS

H. Horie et al., "Effect of Rare Earth Elements on Nodule Count in Spheroidal Graphite Cast Iron with Thin Section", Imono, 57(12):778–783 (1985)—English language Synopsis attached.

*Primary Examiner*—Melvyn Andrews
*Attorney, Agent, or Firm*—Finnegan, Henderson, Farabow, Garrett & Dunner

[57] ABSTRACT

An additive for use in producing spheroidal graphite cast iron of the present invention contains a fine particle of magnesium oxide having a purity of 90 weight % or more and at least one selected from the group consisting of a graphite-spheroidizing material, an inoculant and a graphite-spheroidizing inoculant. The fine particle of highly pure magnesium oxide increases the number of nuclei in a melt, and as a result thereof, increases the graphite spheroid count of a spheroidal graphite cast iron being produced. Another additive for use in producing spheroidal graphite cast iron of the present invention contains at least one selected from the group consisting of a graphite-spheroidizing material, an inoculant and a graphite-spheroidizing inoculant, and an oxide of a metal which has, at a temperature of a melt at a time when subjected to a graphite-spheroidizing treatment, an affinity for oxygen smaller than that of a graphite-spheroidizing element being used in the graphite-spheroidizing treatment. By adding to the melt the metal oxide which oxidizes the graphite-spheroidizing element in the melt to an oxide thereof, a great number of fine oxide particles of the graphite-spheroidizing element is dispersed in the melt to provide a spheroidal graphite cast iron having a great number of fine graphite spheroids and a small chill area ratio.

8 Claims, 12 Drawing Sheets

ADDITIVE FOR USE IN PRODUCING SPHEROIDAL GRAPHITE CAST IRON

BACKGROUND OF THE INVENTION

The present invention relates to an additive for adding to a melt for producing spheroidal graphite cast iron, a production method of spheroidal graphite cast iron and articles of spheroidal graphite cast iron. More specifically, the present invention relates to an additive effective for producing a spheroidal graphite cast iron having a large graphite spheroid count (the number of spheroidal graphite particles) with little chilled structure and a production method of such a spheroidal graphite cast iron.

The inoculation treatment of a melt for producing spheroidal graphite cast iron has been done generally with a view to increasing the mechanical strength, improving the metal structure, preventing the formation of chilled structure, improving the mass effect, preventing the formation of shrinkage cavity, etc. As the inoculant, alloys mainly comprising a graphitizing Si, such as Fe—Si(75% ) alloy, etc., have been widely used in the art and added to the melt just before the casting operation. As the spheroidizing elements (nodulizing elements), Mg, Ce, Ca, Ba, Sr, Y, etc. have been known and used in combination with the inoculant.

The inoculant for promoting the graphitization includes 75% Fe/Si (for example, 76.5% Si, 0.5% Ca, 1.3% Al), Ca/Si (for example, 57.5% Si, 14.0% Ca, 1.0% Al), etc., and is characterized by containing Si and Ca as the main component and other components such as Al, Sr, Mg, Ti, Zr, Ce, Ba and RE (rare earth elements) in the form of metal or alloying component.

Regarding the mechanism of graphitization promoted by inoculation, various opinions have been proposed. One of them explains that a heterogeneous nucleus formed by oxides, sulfides or carbides contributes as the substrate for the graphitization. Another explains that the melt is locally supersaturated with carbon during Si is diffused throughout the melt just after the inoculation, and nuclei for graphitization are formed in the supersaturated portion. The sulfide theory is based on the fact that Ca and Al in inoculant are easily converted into sulfides and graphite grows on the sulfides. However, there are many phenomena that cannot be explained by the sulfide theory. Therefore, it has not yet been established which theory is correct.

As mentioned above, various theories have been proposed on the promotion of forming graphite spheroids by inoculation. Although, the mechanism of the promotion has not yet been established, the addition of the inoculant are widely practiced in the art to prevent the formation of chilled structure, to improve the matrix, to minimize the shrinkage, and many proposals have been presented on the inoculant, other additive alloys and production method of spheroidal graphite cast iron.

Japanese Patent Laid-Open No. 54-115612 discloses an additive for desulphurizing a molten iron and molten steel and spheroidizing graphite. The additive is produced by uniformly mixing 10–50% of particles and small pieces of magnesium or an alloy containing 80% or more of magnesium, each being subjected to surface coating treatment with an organic and inorganic compound and having a size of 10 mm or less, 30–80% of at least one selected from the group consisting of magnesia, silicon carbide, zirconium oxide and alumina, 5–40% of at least one selected from the group consisting of charcoal, activated carbon and coke, and 1–10% of bastnaesite and/or witherite (barium carbonate); adding a binder to the mixture; granulating; and shaping. On page 2, lines 6–14 of lower left column, it is taught that "in the present invention, a mixture mainly containing particles and small pieces of magnesium or an alloy containing 80% or more of magnesium and magnesia, silicon carbide, etc. is added with charcoal, coke, bastnaesite and witherite (barium carbonate), and then granulated or shaped by using various binders. One of the most important features of the invention is to protect magnesium from substances such as moisture, air, etc., which are reactive to magnesium, by subjecting the surface of magnesium and magnesium alloy to inactivation coating treatment."

Japanese Patent Laid-Open No. 54-33818 relates to a method of producing spheroidal graphite cast iron characterized in that a shaped article of a mixture containing an ultrafine powder of metallic magnesium and an oxide of magnesium is added to a molten metal. The shaped article is produced by shaping a mixture containing metallic magnesium and magnesium oxide, and heating the mixture. Alternatively, the shaped article is produced by shaping a mixture containing metallic magnesium and magnesium oxide with an organic high-molecular weight compound. It is taught that metallic magnesium obtained by reducing magnesium oxide with carbonaceous substance is particularly preferable. The mixture comprises 5–90 weight % of metallic magnesium and 95–10 weight % of magnesium oxide. Metallic magnesium is in the form of ultrafine powder (0.01–10 $\mu$m), and the surface thereof is coated by magnesium oxide. The coating of magnesium oxide is taught to effectively avoid violent reaction of metallic magnesium at the time of addition to a molten metal and secure a gentle reaction. Further, the ultrafine metallic magnesium proceeds the reaction in the molten metal uniform. It is also taught that the shaped article of the mixture containing ultrafine metallic magnesium and oxide of magnesium is effective when added in an amount of 0.05 weight % or more in terms of magnesium based on the amount of molten metal. By such an addition amount, graphite is effectively spheroidized by magnesium oxide to finely disperse the graphite particles in the cast ion, and the number of the graphite particles per unit rupture cross-section can be increased.

Japanese Patent Laid-Open No. 54-124814 discloses a metallurgical additive comprising magnesium and magnesium oxide which is prepared by heating metallic magnesium and/or a magnesium alloy to generate a vapor of magnesium, contacting the vapor with a gas containing carbon monoxide, and cooling. The resultant mixture containing Mg, MgO and carbon formed by the reduction of CO may be used with or without shaping using an organic binder or by heating. The weight ratio is 5–90 parts for Mg and 95–10 parts for MgO. It is taught that MgO prevents the violent reaction of Mg in the molten metal and the fine Mg particles generate ultrafine bubbles of Mg vapor in the molten metal which disperse through the molten metal. Therefore, the reaction efficiently proceeds, and the desulphurization rate and the efficiency of Mg utilization are extremely increased. Also, since the surface of Mg and MgO is covered with an organic binder, the additive is easy to handle and can be stored over a long period of time.

In the production of spheroidal graphite cast iron, it is important to finely disperse a great number of graphite spheroids (nodules) in the melt in view of preventing the formation of chilled structure by controlling the cooling rate of the solidified melt and improving the various mechanical properties of the cast product. Therefore, many consideration has been given to the improvement of the inoculant such as Si-based alloy, the nodulizing material, the inoculation method such as the stream inoculation, etc.

However, since the nodulization (spheroidization) and the inoculation effect are insufficient in the production methods conventionally employed in the art, it is difficult to produce a good spheroidized graphite structure as well as to obtain a spheroidal graphite cast iron having good properties due to an excess amount of chilled structure and an insufficient ferritization caused by an insufficient graphitization and a decreased number of graphite spheroids. In particular, in the production of a spheroidal graphite cast iron having both a thin section with a thickness of 5 mm or less and a thick section with a thickness exceeding 5 mm in as cast state, the thin section is likely to form the chilled structure due to rapid cooling of the solidified melt and a post-heat treatment is frequently required to change the pearlitic matrix to the ferritic matrix. Since the solidification of the melt slowly proceeds in the thick section, the graphitization is insufficient in the thick section.

OBJECT AND SUMMARY OF THE INVENTION

Accordingly, an object of the present invention is to provide an additive for use in producing spheroidal graphite cast iron, which increases the number of nuclei for graphite spheroids in the melt to increase the graphite spheroid count thereby promoting the ferritization and preventing the formation of chilled structure.

Another object of the present invention is to provide a production method of spheroidal graphite cast iron having, in as cast state, a thin section with a thickness of 5 mm or less and/or a thick section with a thickness larger than 5 mm, in which a little amount of chilled structure is formed and a great number of graphite spheroids is uniformly distributed.

A still another object of the present invention is to provide an article of spheroidal graphite cast iron produced by the above production method.

The present inventors have made a detailed study on the structure of graphite spheroids in the spheroidal graphite cast iron using electron microscope. FIG. 1 is a scanning electron microphotograph (magnification: ×7000) showing a reflected electron image of a graphite spheroid in a spheroidal graphite cast iron. A central white oval area is a nucleus and a black area surrounding the white area is graphite. The white area scattered in the black area is iron included in the graphite. FIG. 2 is a scanning electron microphotograph (magnification: ×30000) showing a secondary electron image of the nucleus shown in FIG. 1. Like FIG. 1, a central white oval area is the nucleus, the black area surrounding the white oval area is graphite, and the white area scattered in the black area is iron included in the graphite. From the analysis of FIGS. 1 and 2, it has been confirmed that the nucleus contains both MgS and MgO and has a diameter of about 1–3 $\mu$m. Graphite adheres and aggregates on the nucleus, and when the diameter reaches about 5 $\mu$m, graphite grows thereon to cover the nucleus thereby forming a graphite spheroid. It can be presumed that MgS and MgO are likely to coexist in the nucleus because both have face-centered cubic structure. If rare earth elements and calcium are used as nodulizing elements, sulfides and/or oxides of such elements can be contained in the nucleus.

As a result of further detailed study of the nucleus for the graphite spheroids, it has been found that MgO contributes as the substrate for forming MgS nucleus on which graphite grows to form graphite spheroids. Thus, the inventors have found that the graphite spheroid count in the melt can be increased when the number of MgS nuclei is increased by allowing a great number of MgO particles to be present in the melt. Namely, the inventors have found that the graphite spheroid count in the melt can be increased when the number of nuclei in the melt is increased by adding to the melt an additive comprising fine particles of a highly pure magnesium oxide and at least one of a graphite-spheroidizing material, an inoculant and an inoculant having a graphite-spheroidizing function (graphite-spheroidizing inoculant), and as a result thereof, it has been found that the formation of chilled structure can be prevented due to the promoted ferritization, the effect of inoculation can be enhanced, and graphite can be effectively spheroidized due to finely dispersed graphite particles.

Further, the inventors have had an idea that the number of sulfide nuclei in the melt, on which graphite directly grows, may be also increased by increasing the number of fine oxide particles of spheroidizing elements other than magnesium such as rare earth elements and calcium, and a spheroidal graphite cast iron having a great number of fine graphite spheroids may be obtained. As a result of further study, the inventors have found that a great number of fine oxide particles of graphite-spheroidizing elements can be formed in the melt by oxidizing the graphite-spheroidizing elements in the melt with a metal oxide of an element other than the graphite-spheroidizing elements.

Thus, a first additive for use in producing spheroidal graphite cast iron of the present invention comprises a fine particle of magnesium oxide having a purity of 90 weight % or more and at least one selected from the group consisting of a graphite-spheroidizing material, an inoculant and a graphite-spheroidizing inoculant.

A first production method of spheroidal graphite cast iron of the present invention is characterized by adding an additive for use in producing spheroidal graphite cast iron to a melt, the additive comprising the fine particle of magnesium oxide having a purity of 90 weight % or more and at least one of the graphite-spheroidizing material and the graphite-spheroidizing inoculant.

A second production method of spheroidal graphite cast iron of the present invention is characterized by adding an additive for use in producing spheroidal graphite cast iron to a melt after subjected to a graphite-spheroidizing treatment, the additive comprising the fine particle of magnesium oxide having a purity of 90 weight % or more and the inoculant.

A second additive for use in producing spheroidal graphite cast iron of the present invention comprises at least one selected from the group consisting of the graphite-spheroidizing material, the inoculant and the graphite-spheroidizing inoculant, and an oxide of a metal which has, at a temperature of the melt at a graphite-spheroidizing treatment, an affinity for oxygen smaller than that of a graphite-spheroidizing element being used in the graphite-spheroidizing treatment.

A third production method of spheroidal graphite cast iron of the present invention is characterized by adding an additive for use in producing spheroidal graphite cast iron to a melt, the additive comprising at least one of the graphite-spheroidizing material and the graphite-spheroidizing inoculant and the oxide of the metal which has, at a temperature of the melt at a graphite-spheroidizing treatment, an affinity for oxygen smaller than that of a graphite-spheroidizing element contained in the graphite-spheroidizing material and/or the graphite-spheroidizing inoculant.

A fourth production method of spheroidal graphite cast iron of the present invention is characterized by adding an additive for use in producing spheroidal graphite cast iron to a melt after subjected to a graphite-spheroidizing treatment, the additive comprising the inoculant and the oxide of the metal which has, at a temperature of the melt at the graphite-spheroidizing treatment, an affinity for oxygen smaller than that of a graphite-spheroidizing element being used in the graphite-spheroidizing treatment.

DETAILED DESCRIPTION OF THE INVENTION

The present invention will be described below more in detail.

[1] First Additive for Use in Producing Spheroidal Graphite Cast Iron

Figure 1:
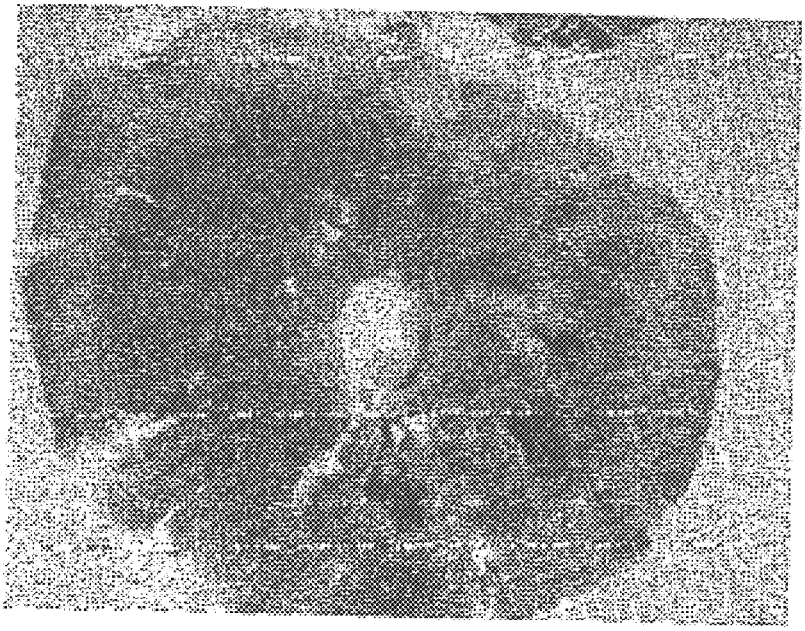
FIG. 1 is a scanning electron microphotograph (magnification: ×7000) showing a reflected electron image of a graphite spheroid of a spheroidal graphite cast iron of the present invention.
Figure 2:
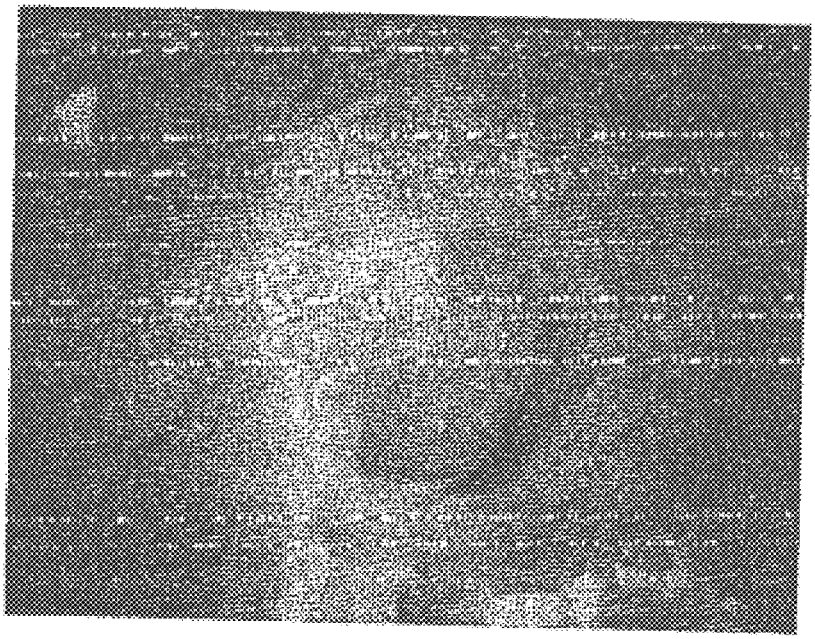
FIG. 2 is a scanning electron microphotograph (magnification: ×30000) showing a secondary electron image of the nucleus of the graphite spheroid.
Figure 3:
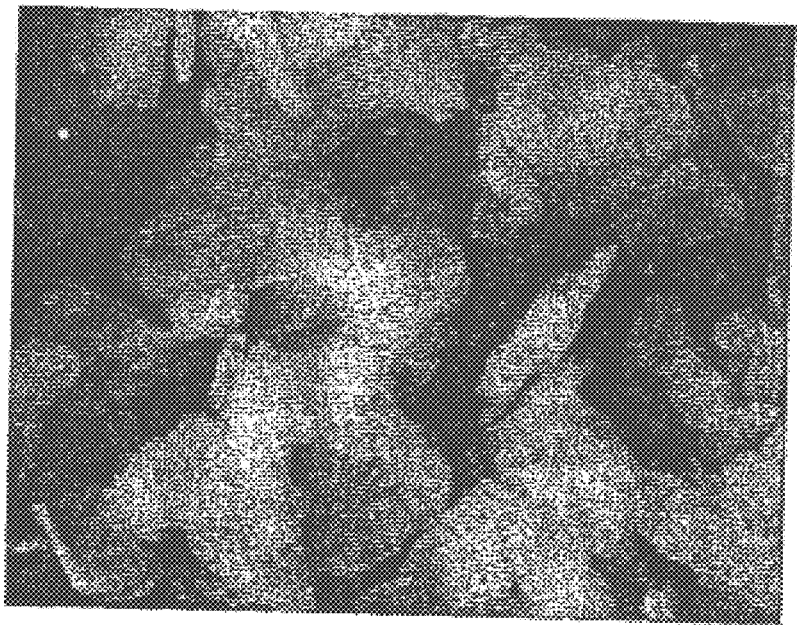
FIG. 3 is a scanning electron microphotograph (magnification: ×30000) showing a secondary electron image of the highly pure magnesium oxide used in the present invention.

The first additive for use in producing spheroidal graphite cast iron of the present invention contains fine particles of magnesium oxide and at least one selected from the group consisting of a graphite-spheroidizing material, an inoculant and a graphite-spheroidizing inoculant. The purity of magnesium oxide is 90 weight % or more, preferably 95 weight % or more. The average particle size of magnesium oxide is 0.001–10 μm, preferably 0.005–5 μm. Magnesium oxide may contain impurities such as Ca, Si, K, Na, Al, Fe, etc. In FIG. 3, a scanning electron microphotograph (magnification: ×30000) of a secondary electron image of fine particles of the highly pure magnesium oxide used in the present invention is shown. The white area indicates MgO particles.

The magnesium oxide particles come to float on the melt surface quite readily during the convectional diffusion in the melt to deteriorate the inoculation effect. To prevent this problem, it is preferable to adhere or support the fine powder of highly pure magnesium oxide on a surface of at least one of the graphite-spheroidizing material, the inoculant and the graphite-spheroidizing inoculant, each having a relatively large specific gravity. Also, the fine powder of highly pure magnesium oxide may be dispersed in at least one of the graphite-spheroidizing material, the inoculant and the graphite-spheroidizing inoculant. It is preferable to shape primary particles, having an average particle size of 0.001–5 μm, of at least one of the graphite-spheroidizing material, the inoculant and the graphite-spheroidizing inoculant into a form of granules, pellets, etc. having an average particle size of 1–20 mm. The fine particle of highly pure magnesium oxide may be kneaded with at least one of the graphite-spheroidizing material, the inoculant and the graphite-spheroidizing inoculant with or without using a binder such as a high-molecular weight organic compound to be shaped into a form of granule, pellet, spheroid, bulky mass, plate, etc. Further, a mixture of the fine particle of highly pure magnesium oxide and at least one of the graphite-spheroidizing material, the inoculant and the graphite-spheroidizing inoculant may be shaped into a form of granule, pellet, spheroid, bulky mass, plate, etc., and then sintered in air, in vacuo or in an inert atmosphere at a temperature lower than the melting point. When the first additive of the present invention produced as mentioned above is added to a melt, the fine particle of highly pure magnesium oxide is uniformly dispersed in the melt to form a great number of nuclei for graphite spheroids.

The graphite-spheroidizing material, the inoculant and the graphite-spheroidizing inoculant conventionally used in the production of spheroidal graphite cast iron may be used in the present invention, and those containing Si, such as Fe—Si, Fe—Si—Mg, Ca—Si, RE-Fe—Si, etc., is particularly preferable. The graphite-spheroidizing inoculant referred to herein includes a physical mixture of the graphite-spheroidizing material and the inoculant and an inoculant containing a graphite-spheroidizing element as the alloying component.

The ratio of the fine particle of highly pure magnesium oxide and at least one of the graphite-spheroidizing material, the inoculant and the graphite-spheroidizing inoculant in the first additive is not critical in the present invention, and usually 0.0001:1 to 0.6:1 by weight.

[2] First and Second Production Methods of Spheroidal Graphite Cast Iron

The first and second production methods of spheroidal graphite cast iron of the present invention is characterized by adding the first additive as described above to a melt for spheroidal graphite cast iron to carry out the graphite-spheroidizing treatment/inoculating treatment. In a preferred first method of production, a first additive containing the highly pure magnesium oxide and at least one of the graphite-spheroidizing material and the graphite-spheroidizing inoculant is placed in a bottom of a ladle with or without other additives generally used. Then, a melt of 1300 to 1550° C. is poured into the ladle to perform the graphite-spheroidizing treatment/inoculation treatment. When a first additive containing the highly pure magnesium oxide and the graphite-spheroidizing material is used, it is preferred to add an inoculant conventionally used in the art to a melt after the addition of the first additive. In a preferred second method of production, a first additive containing the highly pure magnesium oxide and the inoculant is added at 1300 to 1550° C. to a melt which is subjected, in advance, to the graphite-spheroidizing treatment in such a manner as known in the art. However, the addition method of the first additive is not restricted to the above methods, and those employed in the art in adding an inoculant and a graphite-spheroidizing material to a melt may be usable in the present invention. The chemical composition of the melt may be that known in the art, and not specifically limited.

The addition amount of the first additive is 0.0001 to 0.5% by weight, preferably 0.001 to 0.2% by weight in terms of the fine particle of highly pure magnesium oxide based on the weight of the melt. When the addition amount of the fine particle of highly pure magnesium oxide is less than 0.0001% by weight, the increase in the number of nucleus for graphite spheroid cannot be expected. When the addition amount exceeds 0.5% by weight, the magnesium oxide particles cannot be dispersed in the melt uniformly, and form agglomerate to float on the melt surface or inhibit the reaction between the graphite-spheroidizing element and the melt.

As described above, the fine particle of highly pure magnesium oxide may be added to the melt together with the graphite-spheroidizing material and/or the graphite-spheroidizing inoculant to perform the graphite-spheroidizing treatment of the melt, together with the inoculant to perform the inoculating treatment of the melt, or together with the graphite-spheroidizing material and the inoculant.

After the addition of the first additive, the melt is poured into a casting mold usually at 1300 to 1450° C., solidified and cooled after the solidification to ordinary temperature at a cooling rate of 1 to 40 K/s to give an as cast spheroidal graphite cast iron.

The above production methods are effective for producing, in particular, a spheroidal graphite cast iron having a thin section of a thickness of 5 mm or less in as cast state, and a spheroidal graphite cast iron having a great number of graphite spheroids (graphite spheroid count of 800 to 1500 particles/$mm^2$), and a small chill area ratio of 10% or less can be obtained. Such a spheroidal graphite cast iron is suitable for an automotive part such as a gear carrier, suspension cross member and suspension subframe.

[3] Second Additive for Use in Producing Spheroidal Graphite Cast Iron

The second additive for use in producing spheroidal graphite cast iron of the present invention contains at least one selected from the group consisting of a graphite-spheroidizing material, an inoculant and a graphite-spheroidizing inoculant and an oxide of a metal which has, at a temperature of a melt at a time when the melt is subjected to a graphite-spheroidizing treatment, an affinity for oxygen smaller than that of a graphite-spheroidizing element being used in the graphite-spheroidizing treatment.

Figure 11:
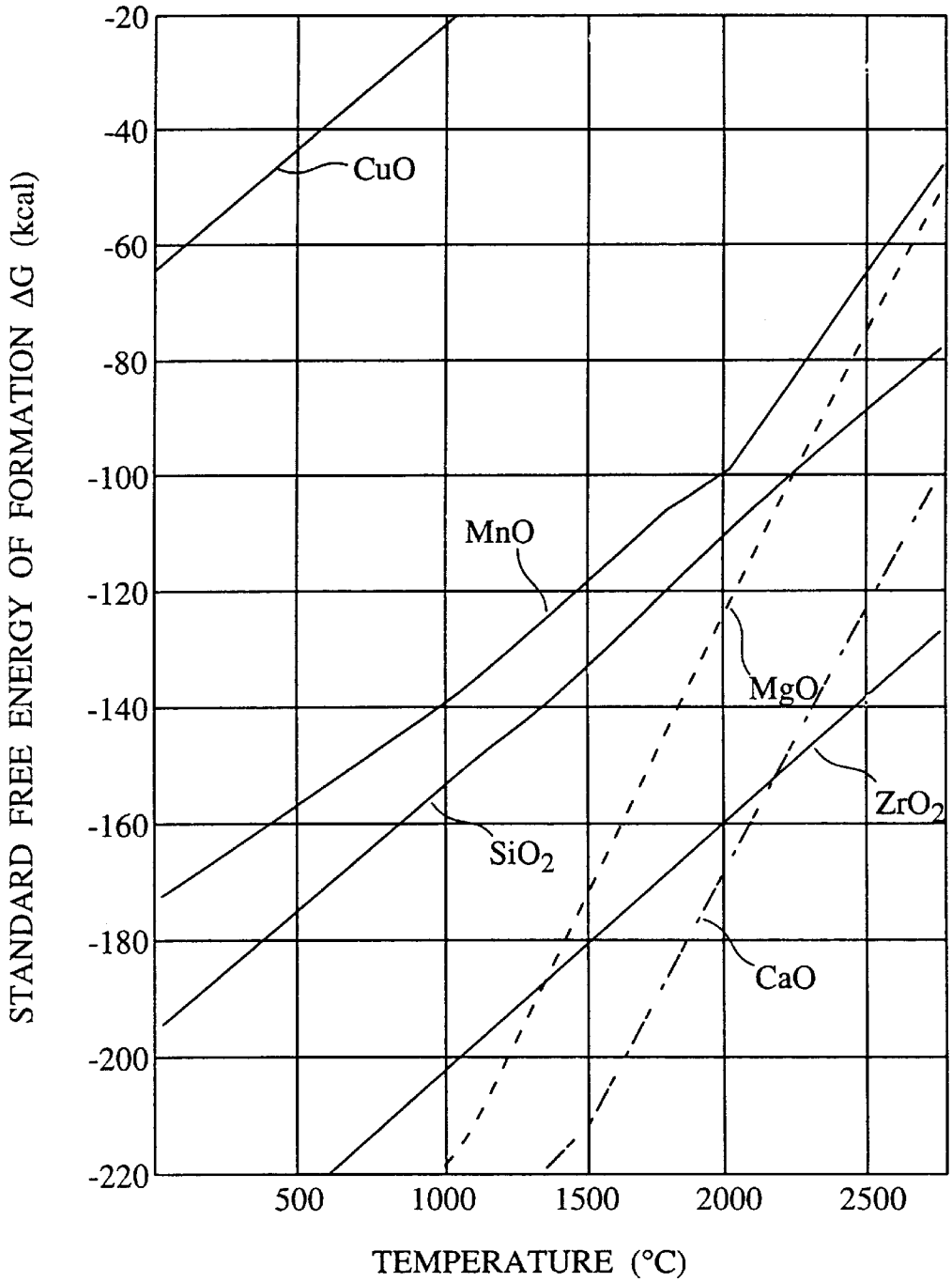
FIG. 11 is a graph showing standard free energy of formation of several oxides as a function of temperature.

FIG. 11 is a graph showing standard free energy of formation of several oxides as a function of temperature. An oxide, such as $SiO_2$, which has a curve at upper left hand of the curve showing MgO oxidizes magnesium in a melt to form numerous fine particles of MgO, while $SiO_2$ is reduced by magnesium to metallic silicon. The second additive for use in producing spheroidal graphite cast iron of the present invention utilizes such a redox reaction between the metal oxide and the graphite-spheroidizing element. For example, MgO particles formed in the melt by the oxidation of magnesium in the graphite-spheroidizing material contribute as the substrate for forming a great number of fine magnesium sulfide nuclei on which graphite directly grows. The magnesium sulfide nuclei thus formed are dispersed in the melt, and a spheroidal graphite cast iron in which a great number of fine graphite spheroids is distributed can be produced.

The graphite-spheroidizing element may include magnesium, rare earth elements and calcium, and magnesium is preferable. The graphite-spheroidizing element may be contained in the second additive as the component of the graphite-spheroidizing material and the graphite-spheroidizing inoculant.

The same graphite-spheroidizing material, the inoculant and the graphite-spheroidizing inoculant as used in the first additive may be usable in the second additive. The graphite-spheroidizing material, the inoculant and the graphite-spheroidizing inoculant usually have an average primary particle size of 0.001–5 $\mu$m, and are preferred to be used in the form of granule, pellet, etc. having an average particle size of 5–20 mm.

The metal oxide which oxidizes the spheroidizing element in the melt to form the oxide of the spheroidizing element may include oxides of silicon, boron, vanadium, manganese, niobium, iron, tin, copper, nickel, etc. Of these oxides, oxides of silicon, nickel and iron are preferable, because these oxides have a graphitizing action and hardly produce white cast iron. The average particle size of the metal oxide is preferably 0.001–5 $\mu$m.

The second additive may be produced in the same manner as in producing the first additive. In addition, the second additive may be produced by subjecting a graphite-spheroidizing material, an inoculant, a graphite-spheroidizing inoculant or a mixture thereof, each containing at least one element selected from the group consisting of silicon, boron, vanadium, manganese, niobium, iron, tin, copper and nickel, to a heat treatment at a temperature lower than the melting point to form the metal oxide layer on the surface.

The ratio of the metal oxide and at least one of the graphite-spheroidizing material, the inoculant and the graphite-spheroidizing inoculant in the second additive is not critical in the present invention, and usually 0.0001:1 to 0.6:1 by weight.

[4] Third and Fourth Production Methods of Spheroidal Graphite Cast Iron

In the third production method of the present invention, added to a melt is a second additive comprising at least one of the graphite-spheroidizing material and the graphite-spheroidizing inoculant and the oxide of the metal which has, at a temperature of the melt when being subjected to a graphite-spheroidizing treatment, an affinity for oxygen smaller than that of a graphite-spheroidizing element contained in the graphite-spheroidizing material and/or the graphite-spheroidizing inoculant. When a second additive containing the graphite-spheroidizing material and the metal oxide is used, it is preferred to add an inoculant conventionally used in the art to a melt after the addition of the second additive. In the fourth production method of the present invention, added to melt after subjected to a graphite-spheroidizing treatment is a second additive comprising the inoculant and the oxide of the metal which has, at a temperature of the melt at a time of the graphite-spheroidizing treatment, an affinity for oxygen smaller than that of a graphite-spheroidizing element being used in the graphite-spheroidizing treatment.

The metal oxide is added to the melt, for example, in the following manners:

(1) The metal oxide is added to a melt after fine powder thereof is mechanically mixed with the graphite-spheroidizing material to adhere or support the metal oxide on the surface of the graphite-spheroidizing material;

(2) The metal oxide is added to a melt after fine powder thereof is mechanically mixed with the graphite-spheroidizing material, and then the mixture is shaped into the form of granule, pellet, spheroid, bulky mass, plate, etc.;

(3) The metal oxide is added to a melt subjected, in advance, to a graphite-spheroidizing treatment after fine powder thereof is mechanically mixed with the inoculant to adhere or support the metal oxide on the surface of the inoculant;

(4) The metal oxide is added to a melt subjected, in advance, to a graphite-spheroidizing treatment after fine powder thereof is mechanically mixed with the inoculant, and then the mixture is shaped into the form of granule, pellet, spheroid, bulky mass, plate, etc.;

(5) An Si-based alloy or inoculant containing the metal oxide is added to a melt subjected, in advance, to a graphite-spheroidizing treatment;

(6) An inoculant containing at least one element selected from the group consisting of silicon, boron, vanadium, manganese, niobium, iron, tin, copper and nickel is heated at a temperature lower than the melting point to form the metal oxide layer on the inoculant surface, and then added to a melt subjected, in advance, to a graphite-spheroidizing treatment; and (7) A graphite-spheroidizing material and/or a graphite-spheroidizing inoculant containing at least one element selected from the group consisting of silicon, boron, vanadium, manganese, niobium, iron, tin, copper and nickel is heated at a temperature lower than the melting point to form the metal oxide layer on the surface thereof, and then added to a melt.

The temperature of the melt to be added with the second additive is preferably 1300 to 1550° C. The metal oxide is preferred to be added to the melt simultaneously with at least one of the graphite-spheroidizing material, the inoculant and the graphite-spheroidizing inoculant. For example, a second additive containing the metal oxide and the graphite-spheroidizing material is placed on the bottom of a ladle, and then a melt for spheroidal graphite cast iron is poured into the ladle. Also, a graphite-spheroidizing material usually used in the art may be first added to the melt, and then, a second additive containing the metal oxide and the inoculant is added to the melt. In this case, since the melt is subjected to casting operation immediately after the formation of the nuclei for the graphite spheroids, disappearance and agglomeration of the nuclei can be effectively prevented to result in a spheroidal graphite cast iron in which a great number of graphite spheroids is distributed more uniformly. The chemical composition of the melt may be that known in the art, and not specifically limited.

For example, the theoretically required amount of oxygen to form the magnesium oxide particles of average particle size of 0.2 $\mu$m in an amount of 2000 particles/mm$^2$ is 8 to 10 ppm at most. However, the oxidization of the graphite-spheroidizing element such as magnesium by the oxide of the metal having an affinity for oxygen smaller than that of the spheroidizing element largely depends on the kind of the metal oxide and the oxidation conditions, and generally, the addition amount of the metal oxide corresponding to the theoretical amount of oxygen fails to form a desired amount of the oxide particles of the graphite-spheroidizing element in the melt. Therefore, the addition amount of the metal oxide is preferably 1 to 100 ppm (0.0001 to 0.01% ) by weight based on the weight of the melt. When the addition amount exceeds 100 ppm, the effective amount of the graphite-spheroidizing element in the melt is decreased thereby producing a spheroidal graphite cast iron having a small rate of graphite spheroidization. The addition amount of at least one of the graphite-spheroidizing material, the inoculant and the graphite-spheroidizing inoculant is preferably 0.5 to 1.5% by weight based on the weight of the melt.

After the addition of the second additive, the melt is poured into a casting mold usually at 1300 to 1450° C., solidified and cooled after the solidification to ordinary temperature at a cooling rate of 1 to 40 K/s to give an as cast spheroidal graphite cast iron having a graphite spheroid count of 800 to 1400 particles/mm$^2$ and a chill area ratio of 5% or less.

The present invention will be further described while referring to the following Examples which should be considered to illustrate various preferred embodiments of the present invention.

EXAMPLE 1

Preparation of Starting Melt

A return scrap (50% by weight), steel scrap (40% by weight) and pure iron (10% by weight) were melted using a high frequency induction furnace to prepare a starting melt having the chemical composition shown in Table 1.

TABLE 1

| Chemical Composition (% by weight) | | | | | | | | |
|---|---|---|---|---|---|---|---|---|
| C | Si | Mn | P | S | Cr | Mg | Al | Cu |
| 3.87 | 1.51 | 0.31 | 0.017 | 0.010 | 0.018 | 0.018 | 0.001 | 0.12 |
| Sn | V | Ti | Mo | Ni | Ca | Ce | | Fe |
| 0.004 | 0.004 | 0.008 | 0.002 | 0.023 | 0.00087 | 0.00852 | | balance |

Treatment of Melt

MgO powder having a purity of 99.9% or more and an average particle size of 0.8 $\mu$m was sprinkled and adhered on the surface of a powdery graphite-spheroidizing material (Fe-45% Si-6% Mg alloy) having an average particle size of 8 mm to prepare an additive of the present invention. The additive was placed on the inner bottom of a ladle and covered with a mild steel scrap. The amount of the additive used was controlled so that the addition amount of MgO was 0.004% by weight and the addition amount of the graphite-spheroidizing material was 0.85% by weight, each based on the weight of the melt. Then, the stating melt in the high frequency induction furnace was poured into the ladle at 1520° C. to perform the graphite-spheroidizing treatment of the melt. Then, the melt was inoculated with Fe-75% Si alloy to adjust the Si concentration to 2.36% by weight.

Production of Test Piece

Figure 12:
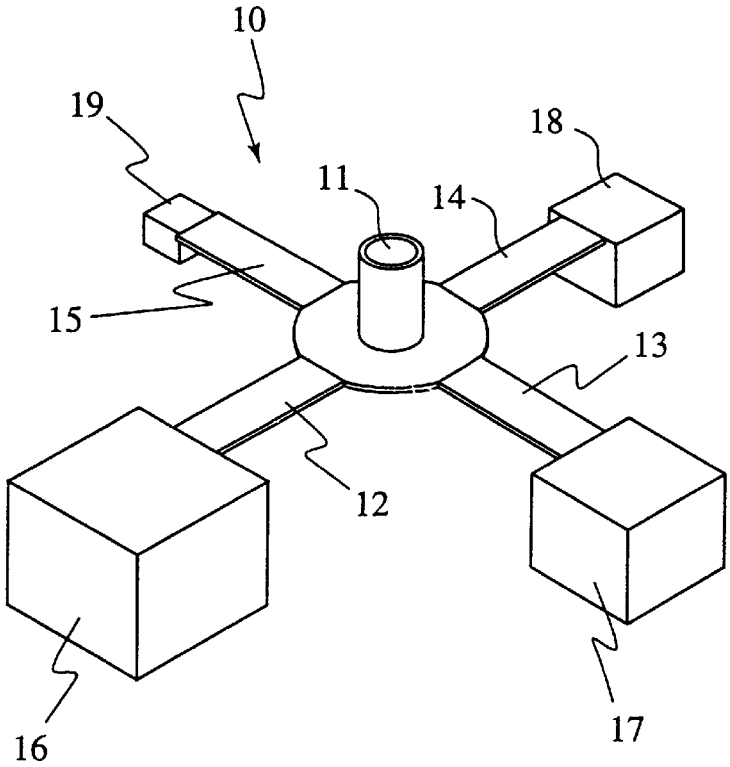
FIG. 12 is a schematic perspective view showing a casting mold used in Example 1 to producing test pieces for evaluating the metal structure of thin spheroidal graphite cast iron.

The melt in the ladle was then poured into a casting mold 10 as shown in FIG. 12 to cast test pieces for evaluating the metal structure of thin cast iron. The apparatus 10, which was devised by the inventors, can estimate the formation of chilled structure and the graphite structure in the actual spheroidal graphite cast iron article having a thin section. The melt poured into the apparatus 10 from an inlet 11 is divided and flows through thin sections 12–15, at which the metal structure is examined, toward wells 16–19, respectively. The thin sections 12–15 have the same dimension, 25 mm width×2 mm thickness×35 mm of length, and the wells 16–19 have different volumes. Therefore, the amounts of melt flowing the thin sections 12–15 differ from each other to result in different rates of solidification of the melt. By comparing the cooling rate after solidification measured by a thermocouple (not shown) provided on each of the thin sections 12–15 and the cooling rate after solidification in casting actual cast iron, and observing the metal structure of the test pieces taken from the thin sections 12–15, the graphite structure and the chill area ratio at a portion of the actual cast iron having a corresponding thickness can be estimated. In Example 1, each volume of the wells 16–19 was 40 times for the well 16, 25 times for the well 17, 10 times for the well 18, 2.5 times for the well 19, each based on the volume of the thin sections 12–15. After completing the solidification of the melt, the test pieces TP(1), TP(2), TP(3) and TP(4) were collected from the thin sections 12, 13, 14 and 15, respectively, and the metal structure of the cross section at the central portion along the lengthwise direction was examined.

Evaluation of Test Piece

The graphite spheroid count (particles/mm$^2$), the ratio of graphite spheroidization (%) and the chill area ratio (%) were determined on each test piece by the following methods.

(1) Graphite Spheroid Count

The graphite spheroid count was determined according to NIK method which was proposed by Nippon Imono Kyokai, Chutetsu Tokushu Bukai, and has been widely employed in the art. Two diagonal lines each having a width of 3 mm were drawn on a card-size photograph (magnification: ×100), and the graphite spheroid on the diagonal lines including those even slightly on the diagonal lines was counted. However, the graphite spheroid having a largest size of 0.5 mm (actual size of 5 $\mu$m) or less was omitted from counting. If the number of the graphite spheroids counted was less than 10, the counting was repeated after the width of the diagonal lines was broadened until the count reached at least 10. The counting was repeated on five fields and the arithmetic mean of the results was employed as the graphite spheroid count of the test piece.

(2) Ratio of Graphite Spheroidization

Figure 13:
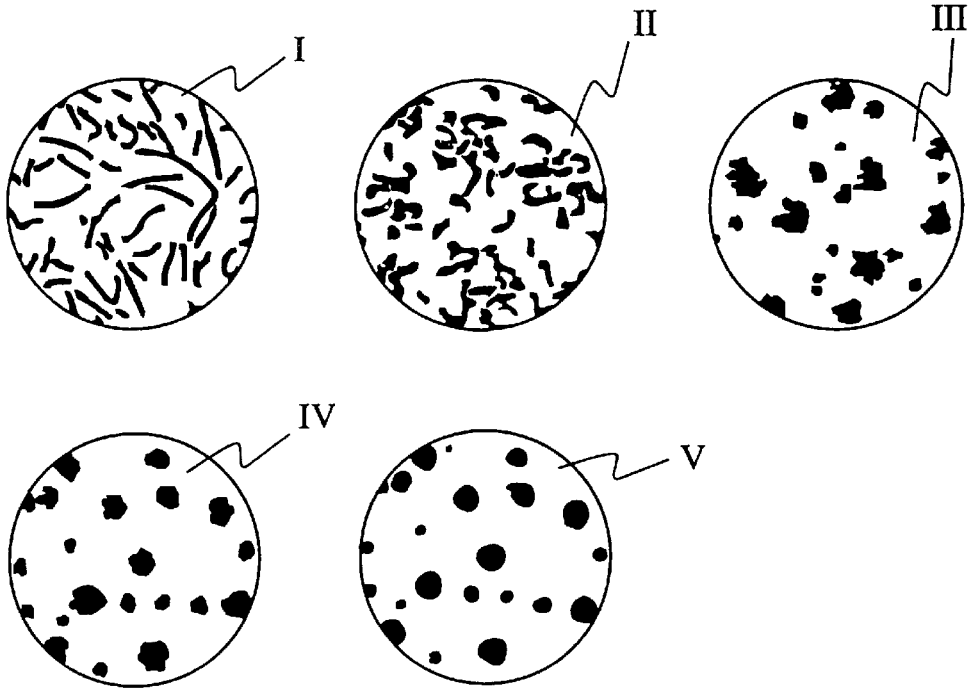
FIG. 13 is an illustration showing the classification of graphite particles employed in NIK method.

The NIK method classifies the graphite particles in the cast iron into 5 groups (I to V) as shown in FIG. 13 and assigns the area ratio and the shape factor for calculating the ratio of graphite spheroidization to each of the groups as shown in Table 2. The area ratio in Table 2 is a ratio of the area of graphite particle to the area of the circle having a diameter corresponding to the largest length of the graphite particle.

TABLE 2

| Classification | I | II | III | IV | V |
|---|---|---|---|---|---|
| Shape Factor | 0 | 0.3 | 0.7 | 0.9 | 1.0 |
| Area Ratio (%) | less than 20 | not less than 20 and less than 40 | not less than 40 and less than 70 | not less than 70 and less than 80 | not less than 80 |

Using the above shape factors, the ratio of graphite spheroidization was calculated from the equation:

$$\text{ratio of graphite spheroidization (\%)}=100\times(0\times n_I+0.3\times n_{II}+0.7\times n_{III}+0.9\times n_{IV}+1.0\times n_V)/(n_I+n_{II}+n_{III}+n_{IV}+n_V),$$

wherein $n_I$ to $n_V$ are the numbers of graphite particles classified into the respective classifications I to V shown in Table 2. The calculation was repeated on five fields and the arithmetic mean of the results was employed as the ratio of graphite spheroidization of the test piece.

(3) Chill Area Ratio

The cross sectional area of each test piece was subjected to a macro-etching by an aqueous solution of $(NH_4)_2S_x$ (S content: 0.6–1.0%) to expose the chilled structure. Then, the chill area ratio was determined by an image analyzer at a magnification of ×25.

The graphite spheroid count, the ratio of graphite spheroidization and the chill area ratio of each test piece are shown in Table 3.

COMPARATIVE EXAMPLE 1

In the same manner as in Example 1 except that only the graphite-spheroidizing material (Fe-45% Si-6% Mg alloy) was used and MgO powder was not added, test pieces TP(1) to TP(4) were cast. The graphite spheroid count, the ratio of graphite spheroidization and the area ratio of graphite were determined on the test pieces in the same manner as in Example 1. The results are shown in Table 3.

TABLE 3

| | Graphite Spheroid Count (particles/mm$^2$) | | | | Ratio of Graphite Spheroidization (%) | | | |
|---|---|---|---|---|---|---|---|---|
| | TP(1) | TP(2) | TP(3) | TP(4) | TP(1) | TP(2) | TP(3) | TP(4) |
| Example 1 | 1211 | 1320 | 1244 | 1160 | 85.5 | 85.9 | 86.1 | 85.9 |
| Comparative Example 1 | 1048 | 908 | 960 | 870 | 82.0 | 84.1 | 83.1 | 83.6 |

| | Chill Area Ratio (%) | | | |
|---|---|---|---|---|
| | TP(1) | TP(2) | TP(3) | TP(4) |
| Example 1 | 0.0 | 0.0 | 0.2 | 4.0 |
| Comparative Example 1 | 0.4 | 3.6 | 6.8 | 7.1 |

As seen from Table 3, in Example 1 in which the inoculant containing MgO was added to the melt, TP(1) to TP(4) showed a graphite spheroid count of 1160 to 1320 particles/mm$^2$, a ratio of graphite spheroidization of 85.5 to 86.1% and a chill area ratio of 0.0 to 4.4%. Upon comparing with the results on the corresponding TP(1) to TP(4) of Comparative Example 1 in which the inoculant containing no MgO was used, it would appear that the spheroidal graphite cast iron of the present invention shows improved results in any of the graphite spheroid count, the ratio of graphite spheroidization and the chill area ratio. Also, these properties hardly vary from test piece to test piece in the present invention to show that the metal structure of spheroidal graphite cast iron is hardly changed even when the cooling rate after solidification is different.

Figure 4:
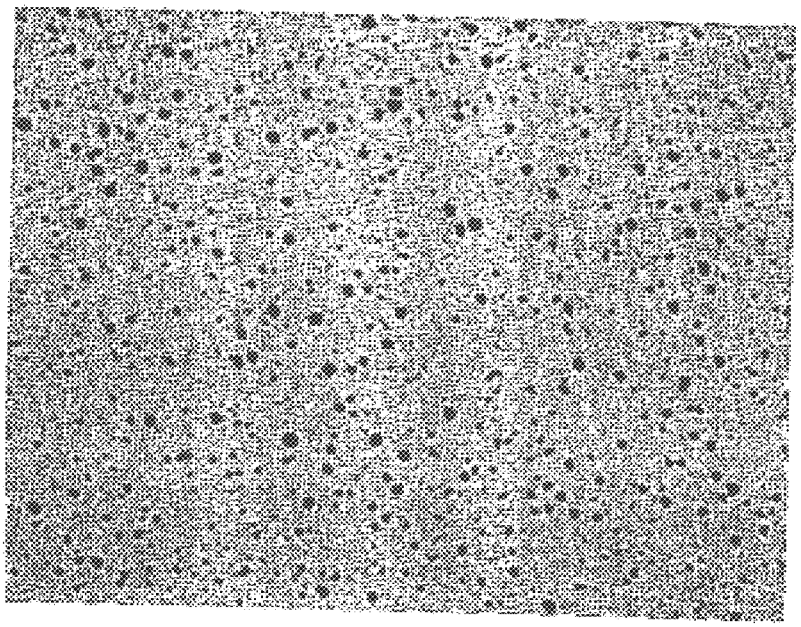
FIG. 4 is a photograph showing the metal structure of the spheroidal graphite cast iron prepared in Example 1.
Figure 5:
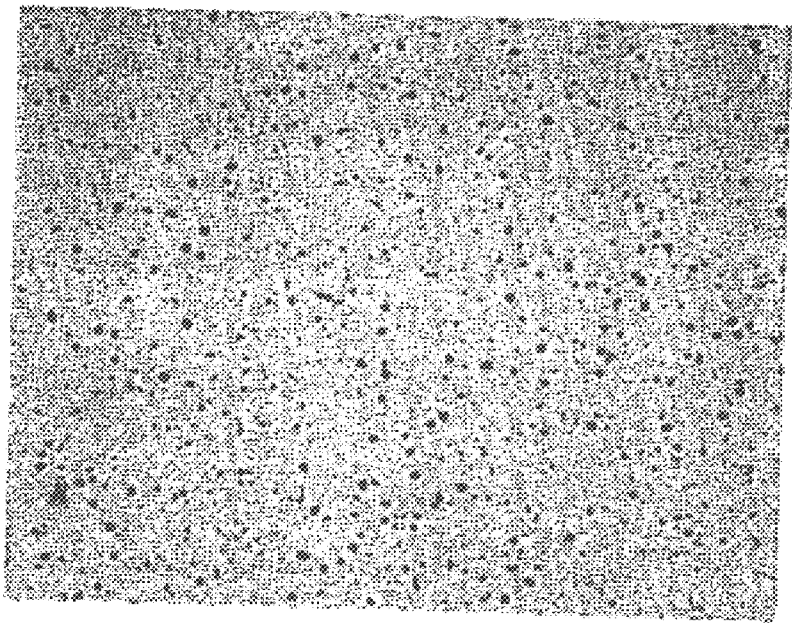
FIG. 5 PRIOR ART
FIG. 5 is a photograph showing the metal structure of the spheroidal graphite cast iron prepared in Comparative Example 1.

FIG. 4 is a photograph (magnification: ×100) showing the metal structure of TP(1) (thickness: 2 mm) prepared in Example 1. As seen from FIG. 4, a great number of fine graphite spheroids is distributed in the cast iron and no formation of chilled structure is found. FIG. 5 is a photograph (magnification:×100) showing the metal structure of TP(1) (thickness: 2 mm) prepared in Comparative Example 1. As seen from FIG. 5, a decreased number of graphite spheroids is contained in the cast iron and the formation of chilled structure is found.

From the above results, it can be seen that the additive containing MgO used in Example 1 exhibits also the inoculation effect to increase the number of graphite spheroids in the spheroidal graphite cast iron. The spheroidal graphite cast iron prepared in Example 1 had a ferritic matrix and the mechanical properties, particularly, elongation property would be expected to be improved due to the promoted graphitization. Since the test pieces used for evaluating the metal structure of thin cast iron all had a thickness of 2 mm, it could be seen that the additive of the present invention containing the fine particles of highly pure magnesium oxide and the graphite-spheroidizing material increases the graphite spheroid count even in a thin section as thin as 2 mm. Further, FIG. 4 shows that the graphite spheroids are uniformly distributed throughout the spheroidal graphite cast iron prepared in Example 1. It would be seen that the fine particles of magnesium oxide are dispersed in the melt uniformly when added to the melt after adhered to the surface of the graphite-spheroidizing material having a relatively large specific gravity as compared when the magnesium oxide is added alone.

EXAMPLE 2 AND COMPARATIVE EXAMPLE 2

Using the same starting melt as used in Example 1, each test piece was cast. MgO particles having an average particle size of 0.24 $\mu$m and a purity of 97% by weight were adhered on the surface of a powdery graphite-spheroidizing material (Fe-45% Si-6% Mg alloy) to prepare an additive. The addition amount was 0.003% by weight for magnesium oxide and 0.85% by weight for the graphite-spheroidizing material, each based on the weight of the melt. The starting melt was poured into a ladle at 1500° C. to perform the graphite-spheroidizing treatment, and then, the melt was inoculated by adding Fe-75% Si alloy in an amount of 0.3%. For comparison, each test piece was prepared in the same manner as above except for using no MgO (Comparative Example 2).

Figure 18A:
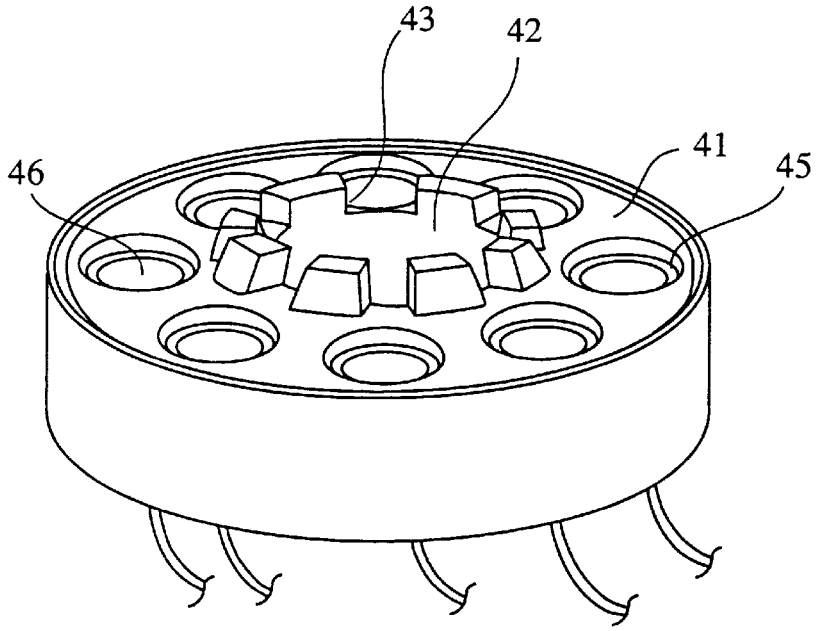
FIG. 18*a* is a schematic perspective view showing the casting mold used in Example 2.
Figure 18B:
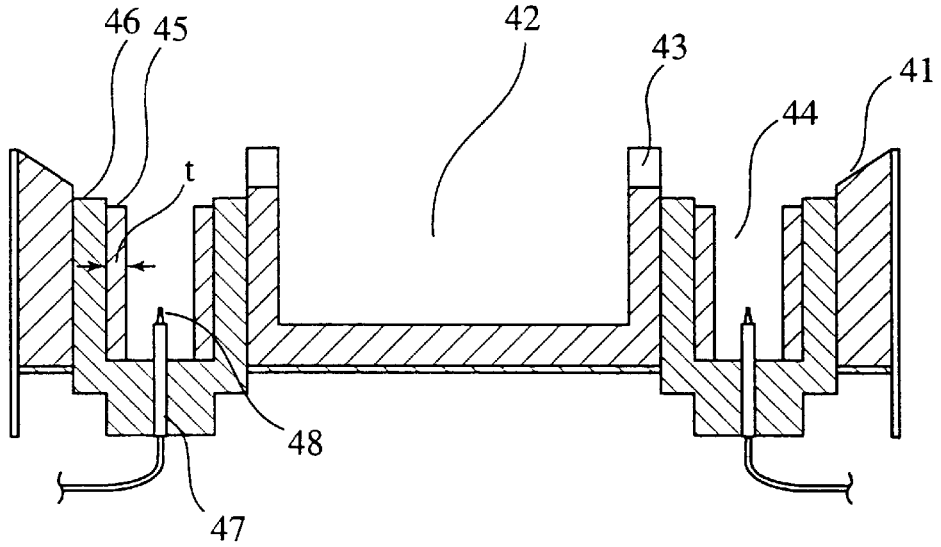
FIG. 18*b* is a cross sectional view of the casting mold shown in FIG. 18*a*.

FIG. 18*a* is a perspective view showing a casting mold 41 used in producing the test pieces, and FIG. 18*b* is a cross sectional view thereof. A melt poured into the casting mold 41 from an inlet 42 is divided, flows through eight gates 43 and enters simultaneously into eight shell cups 46, each having an inner diameter of 38.5 mm and a depth of 51 mm. Into the eight shell cups 46, respective cylindrical steel chillers 45 having a thickness of 2.0, 3.0, 3.5, 4.0, 4.5, 5.0 and 7.0 mm, respectively. At the central portion of the bottom of each shell cup 46, an R thermocouple is disposed. In FIG. 18*b* , "47" is a protecting tube for the thermocouple, "t" is a thickness of the chiller 45, and "44" is a hollow space. Since the thickness of a chiller is different from each other, the melt in each shell cup 46 is cooled at a cooling rate different from those of melts in any of the other shell cups before, during and also after the solidification. After completion of the solidification, the chill area ratio of the metal structure near the thermocouple was determined.

Figure 14:
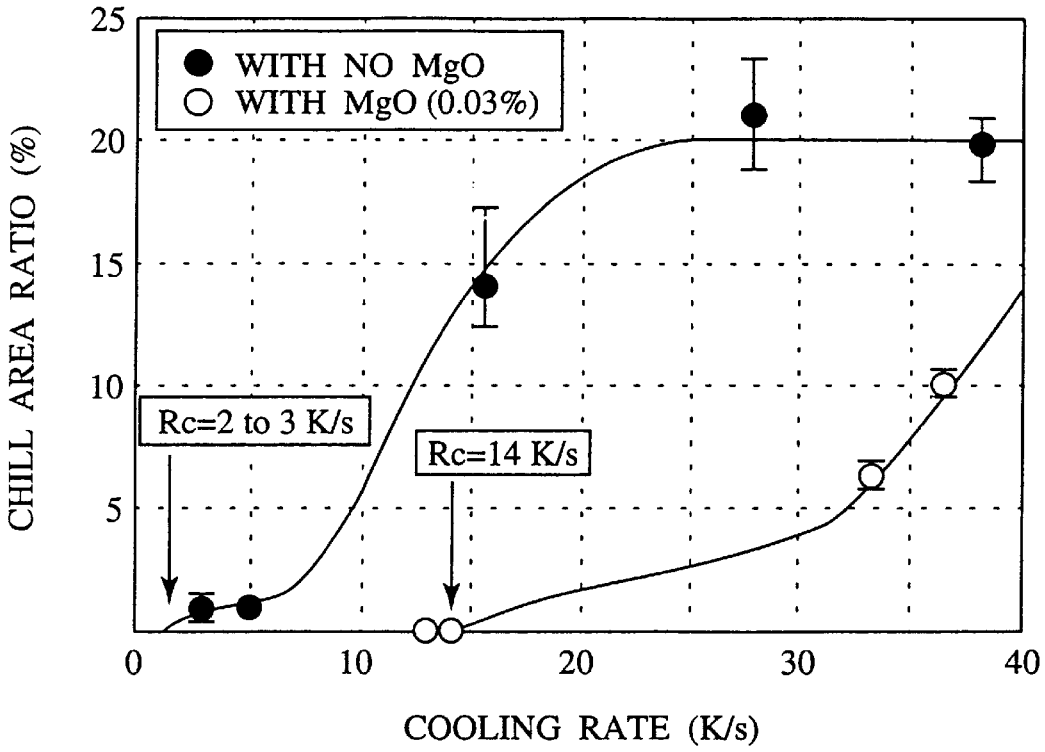
FIG. 14 is a graph showing the relationship between the cooling rate of the melt and the chill area ratio.

From the cooling rate measured during the casting of each test piece and the chill area ratio measured on each test piece, the critical cooling rate of forming chilled structure, namely, the cooling rate at which formation of chilled structure occurs was determined to evaluate the effect of the inoculant according to the present invention on preventing the formation of chilled structure. FIG. 14 is a graph showing the relationship between the cooling rate (K/s) of the melt and the chill area ratio (%) in the cast iron. The chill area ratio was measured on 100 fields (each 0.9 mm×0.7 mm) of the metal structure near the portion at which the temperature of the melt was measured by the thermocouple. The measurement was repeated on five portions and the arithmetic mean of the results was employed as the chill area ratio of the test piece. The cooling rate shown in FIG. 14 is a maximum cooling rate of the solidified melt. "K" is Kelvin temperature and "s" is second.

Figure 6:
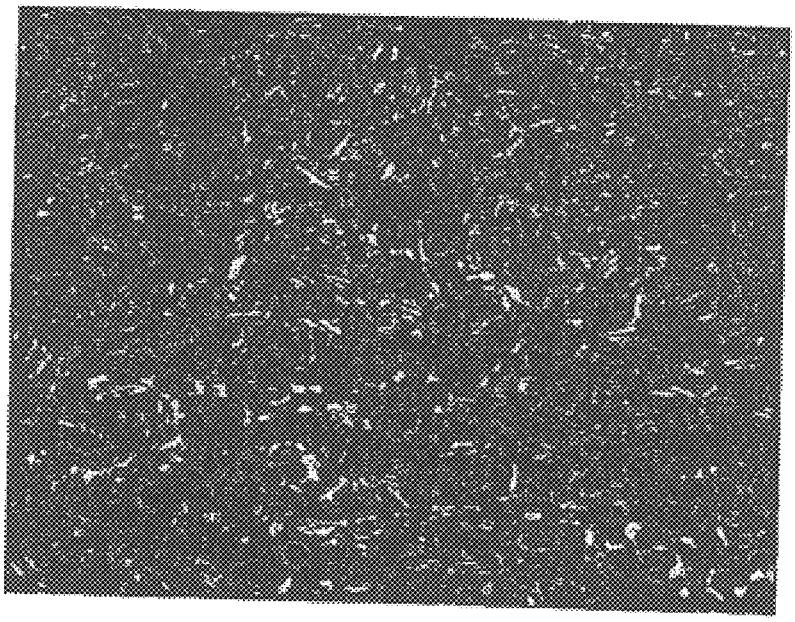
FIG. 6 is a photograph showing the metal structure of the spheroidal graphite cast iron prepared in Example 2 using an MgO-containing additive for use in producing spheroidal graphite cast iron.
Figure 7:
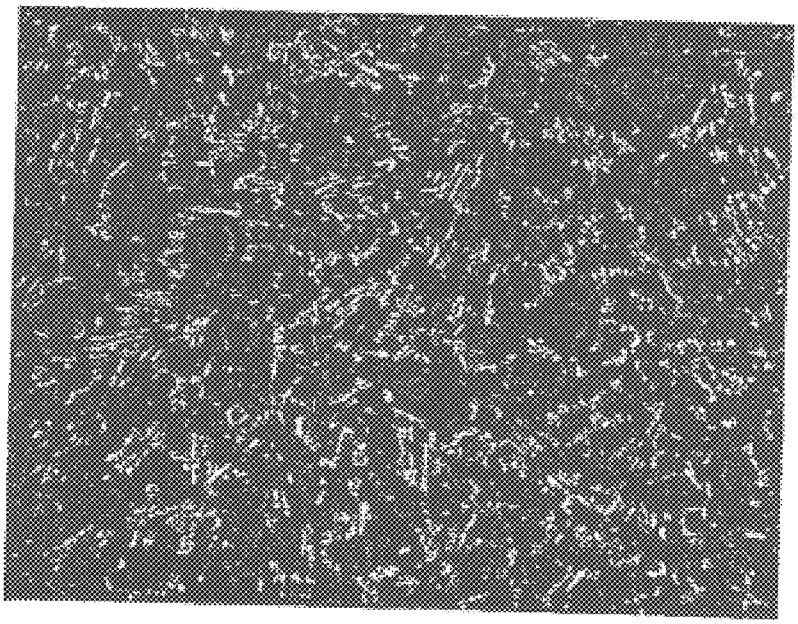
FIG. 7 PRIOR ART
FIG. 7 is a photograph showing the metal structure of the spheroidal graphite cast iron prepared in Comparative Example 2 using only a graphite-spheroidizing material without using MgO.

As seen from FIG. 14, the critical cooling rate of forming chilled structure (Rc) was 14 K/s or more when the additive containing MgO was added to the melt. On the other hand, the critical cooling rate (Rc) was as small as 2–3 K/s when only the graphite-spheroidizing material was used and no MgO was added to the melt. Further, it can be seen that the chill area ratio was as low as 6.2% even at a relatively high cooling rate of 33.3 K/s when the additive containing MgO was added to the melt. A photograph (magnification: ×100) of the metal structure of such a cast iron is shown in FIG. 6. FIG. 7 is a photograph (magnification:×100) showing the metal structure of the cast iron obtained by using only the graphite-spheroidizing material without adding no MgO and cooling at a cooling rate of 27.8 K/s. It would appear that the chill area ratio reaches a higher level of 21.1% when the cooling rate is 27.8 K/s. In FIGS. 6 and 7, white area shows the chilled structure. From the above results, it can be seen that the additive for use in producing spheroidal graphite cast iron of the present invention raises the critical cooling rate of forming chilled structure (Rc) and effectively prevents the formation of chilled structure.

EXAMPLE 3

FIGS. 15*a*, 15*b*, 16*a*, 16*b* and 17 are schematic illustrations showing typical examples of automotive parts such as a gear carrier, a suspension cross member and a suspension subframe.

Figure 15A:
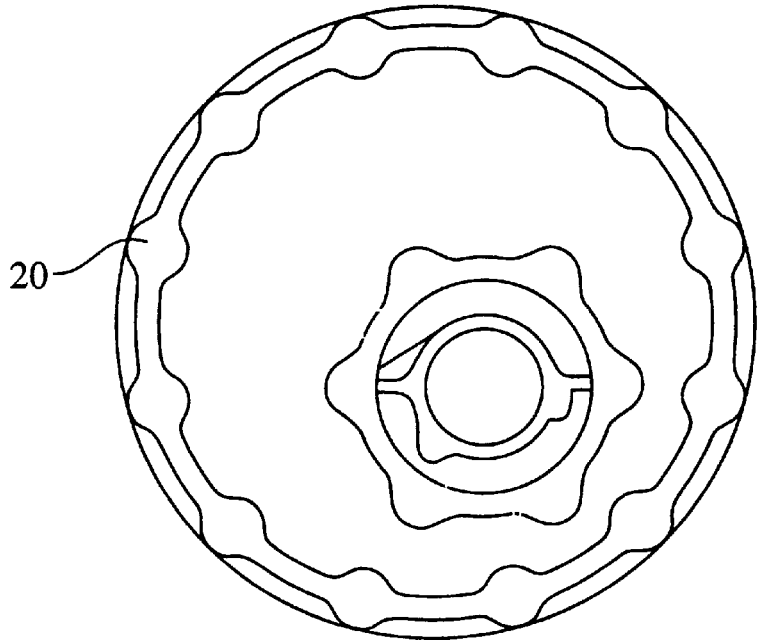
FIG. 15*a* is a schematic illustration showing a plan view of a gear carrier.
Figure 15B:
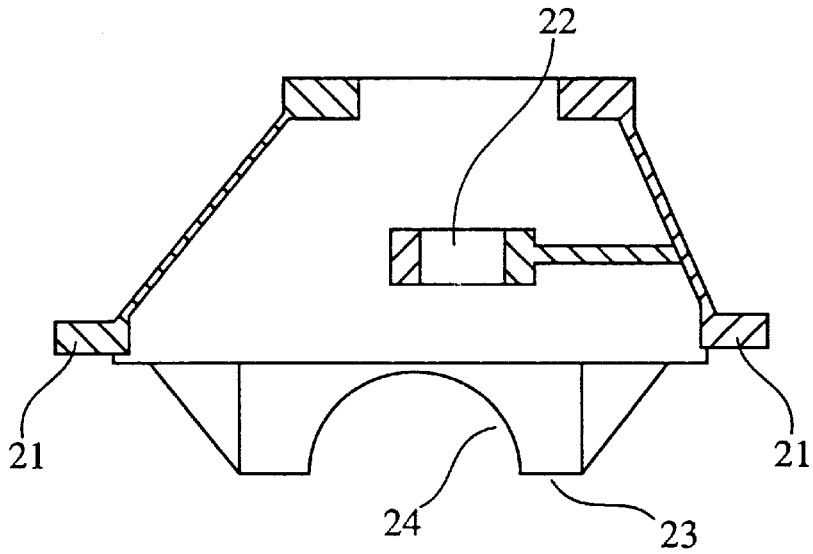
FIG. 15*b* is a cross sectional view of the gear carrier shown in FIG. 15*a;*

The gear carrier has a plurality of bosses 20 along its periphery as shown in FIG. 15*a*, and has a pilot bearing 22 at the central portion as shown in FIG. 15*b*. Flange 21 is provided on the lower end periphery, and in the central portion thereof, a bearing mount 24 and a cap receiver 23 are provided.

Figure 16A:
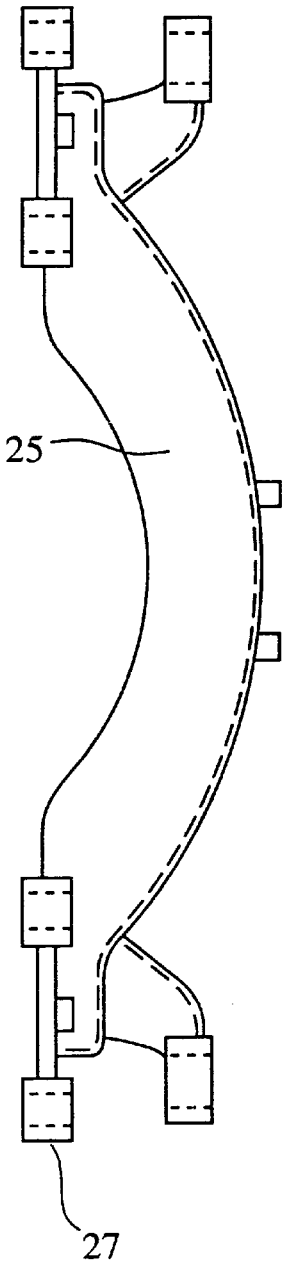
FIG. 16*a* is a schematic illustration showing a side view of a suspension cross member.
Figure 16B:
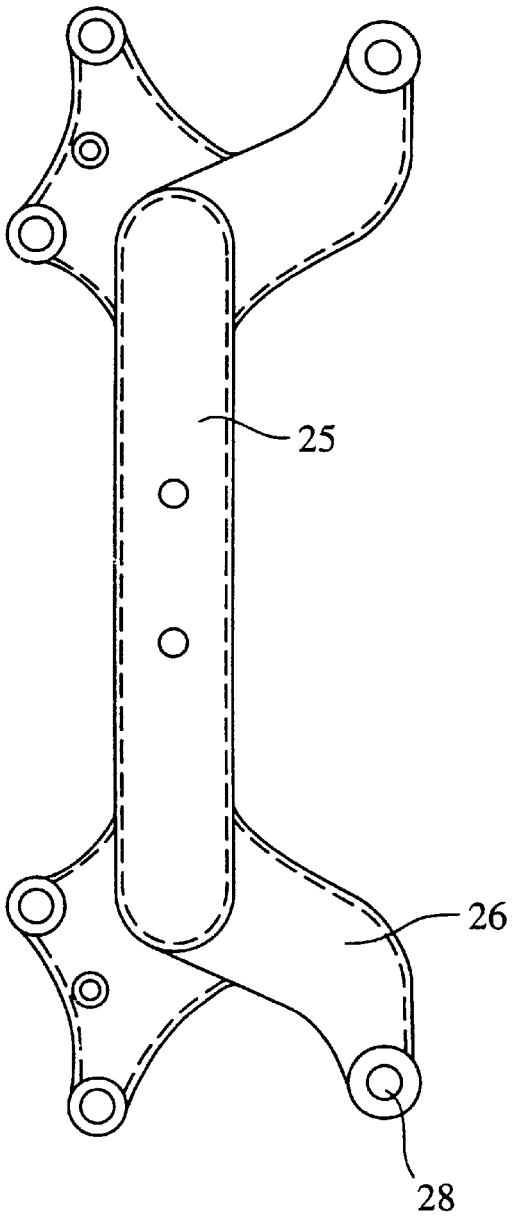
FIG. 16*b* is a plan view of the suspension cross member shown in FIG. 16*a;*

The suspension cross member shown in FIGS. 16*a* and 16*b* has a wing portion 26 at each end of a body portion 25, a boss 27 at the end of the wing portion 26 and a boss 28 for fitting to an automotive body on the boss 27.

Figure 17:
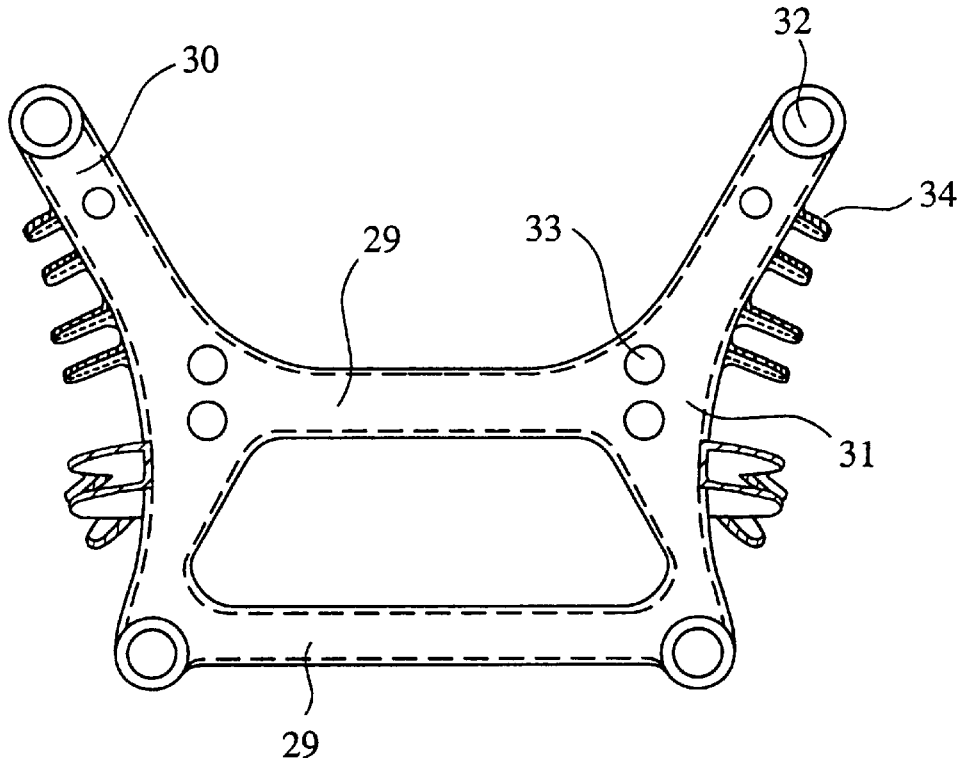
FIG. 17 is a schematic illustration showing a suspension subframe.

In the suspension subframe shown in FIG. 17, a cross beam 29 at the central portion has a side beam 31 at both the end thereof. A wing portion 30 extends from the shoulder of each side beam 31, and a boss 32 for fitting to an automotive body is provided on the end of the wing portion 30. The side of the wing portion 30 has a plurality of link receivers 34 and the shoulder of the side beam 31 has a boss 33.

The above automotive parts have a thin section having an as cast thickness of 5 mm or less, a thick section having an as cast thickness exceeding 5 mm, or both the thin section and the thin section.

In the same manner as in Example 1, each of the gear carrier, the suspension cross member and the suspension subframe was cast from a starting melt similar to that used in Example 1. An additive containing MgO particles adhered on the surface of a powdery graphite-spheroidizing material (Fe-45% Si-6% Mg alloy) having an average particle size of 12 mm was used. The average particle size of MgO was 1 μm and the purity thereof was 98% by weight. The addition amount was 0.005% by weight for MgO and 0.85% by weight for the graphite-spheroidizing material, each based on the weight of the melt. The melt flow under casting operation was post-inoculated by adding Fe-75% Si alloy having an average particle size of about 1 mm in an amount of 0.1–0.2 weight %. The temperature of the melt after added with the additive was 1365° C.

After examining the gear carrier, the suspension cross member and the suspension subframe thus cast, it was confirmed that no formation of chilled structure was found in any of the thin section having an as cast thickness of 5 mm or less and the thick section having an as cast thickness exceeding 5 mm.

EXAMPLE 4

A powdery graphite-spheroidizing material (Fe-45% Si-5% Mg alloy) having an average particle size of about 8 mm and a powdery silicon dioxide having an average particle size of 0.8 μm were mechanically mixed to adhere the silicon dioxide particles on the surface of the graphite-spheroidizing material particles, thereby preparing an additive of the present invention. The mixture thus prepared was placed on the bottom of a ladle, and the mixture was then successively covered with a primary inoculant (Fe—Si(75% ) alloy) having an average particle size of 5 mm and an iron scrap. A starting melt similar to that used in Example 1 was poured into the ladle at 1500° C. to conduct a spheroidizing treatment. The addition amount was 0.95% by weight for the graphite-spheroidizing material, 30 ppm by weight for silicon dioxide, 0.15% by weight for the primary inoculant and 0.7% by weight for the iron scrap, each based on the weight of the melt. After the spheroidizing treatment, a secondary inoculant (Fe—Si(75% ) alloy) was added to the melt surface in an amount 0.2% by weight based on the melt, and then, the melt was stirred. Then, the melt was poured into the casting mold shown in FIG. 12 at 1400° C. to cast a test piece of 2 mm thickness.

Figure 8:
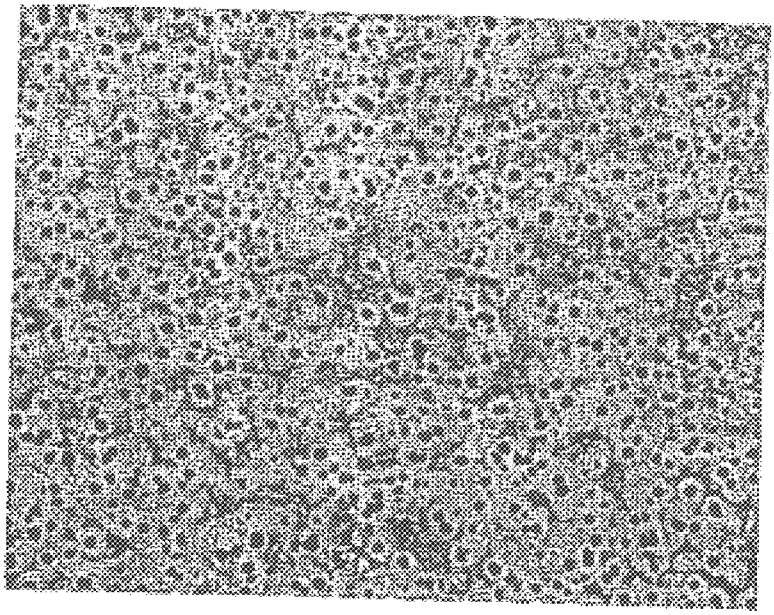
FIG. 8 is a photograph showing the metal structure of the spheroidal graphite cast iron prepared in Example 4.

After solidification and cooling, the metal structure of the cross section of the test piece was observed. An optical photograph (magnification: ×100) of the cross sectional metal structure (TP(3) from the thin section 14) is shown in FIG. 8. As a result of the observation, the graphite spheroid count was 835 particles/mm$^2$ and the chill area ratio was 2.6%.

EXAMPLE 5

The same graphite-spheroidizing material and primary inoculant used in Example 4 were heated at 700° C. for one hour to oxidize the surface thereof. In the same manner as in Example 4 except for using the graphite-spheroidizing material and primary inoculant thus treated, a test piece of spheroidal graphite cast iron was cast. As a result of the observation, the graphite spheroid count was 870 particles/mm$^2$ and the chill area ratio was 0.3%.

EXAMPLE 6

Figure 9:
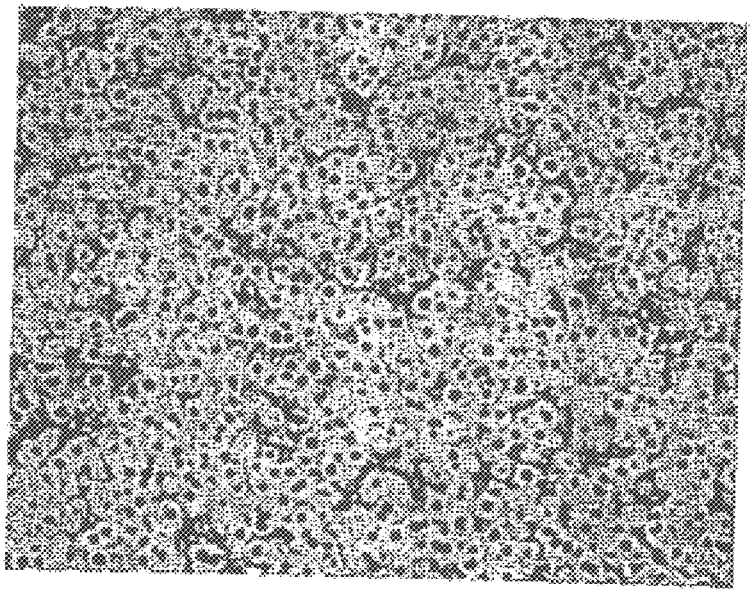
FIG. 9 is a photograph showing the metal structure of the spheroidal graphite cast iron prepared in Example 6.

In the same manner as in Example 4 except for an amount of iron oxide (III) ($Fe_2O_3$) was mechanically mixed with the same graphite-spheroidizing material as used in Example 4, a test piece of spheriodial graphite cast iron was cast. The addition amount of iron oxide (III) was 0.006% by weight based on the weight of the melt and the average particle size thereof was about 1 μm. An optical photograph (magnification: ×100) of the cross sectional metal structure of the test piece (TP (3) from the thin portion 14) is shown in FIG. 9. The graphite spheroid count was 919 particles/mm$^2$ and no chilled area was found in the cross section of the test piece.

EXAMPLE 7

In the same manner as in Example 4 except for an amount of magnesium oxide having an average particle size of 1 μm or less was mechanically mixed with the same graphite-spheroidizing material as used in Example 4, a test piece of spheroidal graphite cast iron was cast. The addition amount of magnesium oxide was 0.004% by weight based on the weight of the melt. The graphite spheroid count was 847 particles/mm$^2$ and the chill area ratio was 0.2%.

COMPARATIVE EXAMPLE 3

Figure 10:
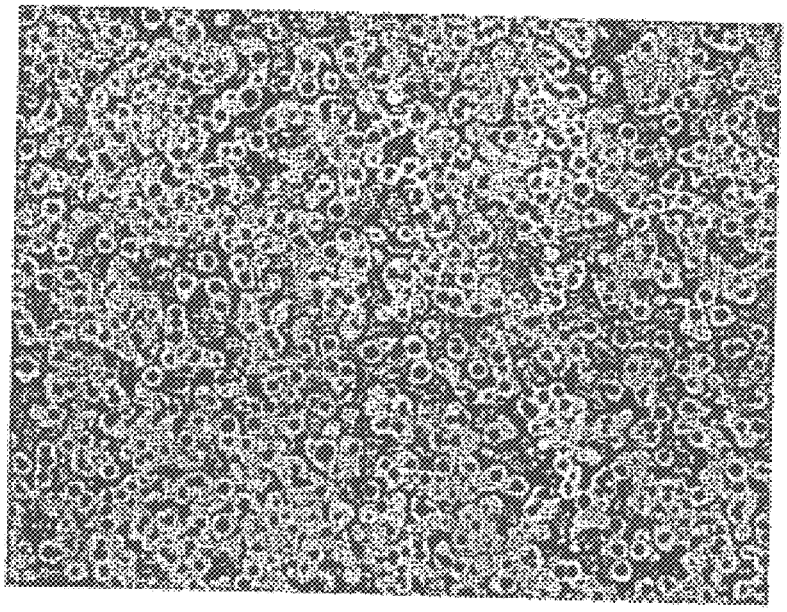
FIG. 10 PRIOR ART
FIG. 10 is a photograph showing the metal structure of the spheroidal graphite cast iron prepared in Comparative Example 3.

In the same manner as in Example 4 except for using no silicon dioxide, a test piece of spheroidal graphite cast iron was cast. An optical photograph (magnification: ×100) of the cross sectional metal structure of the test piece (TP (3) from the thin portion 14) is shown in FIG. 10. The graphite spheroid count was 770 particles/mm$^2$ and the chill area ratio was 10.5%.

As described above, the first additive of the present invention extremely increases the number of graphite spheroids in a spheroidal graphite cast iron due to the fine particles of highly pure magnesium oxide contained in the additive. The addition of the first additive of the present invention to the melt produces an increased number of nuclei for graphite spheroids to prevent the formation of chilled structure. Therefore, the spheroidal graphite cast iron is expected to be improved in the mechanical properties. Further, the cast article made of the spheroidal graphite cast iron cast by adding the first additive of the present invention has a sufficient number of graphite spheroids for preventing the formation of chilled structure in any of the thin section having an as cast thickness of 5 mm or less and the thick section having an as cast thickness exceeding 5 mm. Therefore, the cast article can be made thinner without deteriorating the mechanical strength and the automotive parts made of cast article, such as a gear carrier, a suspension cross member and a suspension subframe, can be reduced in the weight.

Since the spheroidizing element is oxidized in the melt by the metal oxide when the second additive of the present invention is added to the melt, a great number of nuclei for graphite spheroids can be finely dispersed in the melt to result in producing a great number of fine graphite spheroids which effectively prevent the formation of chilled structure. Therefore, the chilled structure is hardly formed even in the thin section which is subjected to rapid cooling and rapid solidification, thereby producing a spheroidal graphite cast iron having desired mechanical properties in as cast state.

What is claimed is:

1. An additive for use in producing spheroidal graphite cast iron, comprising (a) a fine particle of magnesium oxide having an average particle size of 0.001–10 μm and a purity of 90 weight % or more, and (b) at least one selected from the group consisting of a graphite-spheroidizing material, an inoculant and a graphite-spheroidizing inoculant, a weight ratio of component (a) to component (b) being 0.0001:1 to 0.6:1.

2. The additive according to claim 1, wherein said fine particle of magnesium oxide is adhered to a surface of at least one selected from the group consisting consisting of the graphite-spheroidizing material, the inoculant and the graphite-spheroidizing inoculant, or said fine particle of magnesium oxide is dispersed in at least one selected from the group consisting of the graphite-spheroidizing material, the inoculant and the graphite-spheroidizing inoculant.

3. The additive according to claim 1, wherein said additive is a shaped article of a mixture of said fine particle of magnesium oxide and at least one selected from the group consisting of the graphite-spheroidizing material, the inoculant and the graphite-spheroidizing inoculant.

4. The additive according to claim 1, wherein said additive is a sintered article of a mixture of said fine particle of magnesium oxide and at least one selected from the group consisting of the graphite-spheroidizing material, the inoculant and the graphite-spheroidizing inoculant.

5. An additive for use in producing spheroidal graphite cast iron, comprising (a) at least one selected from the group consisting of a graphite-spheroidizing material, an inoculant and a graphite-spheroidizing inoculant, and (b) an iron oxide powder having an average particle size of 0.001–5 μm, a weight-ratio of component (a) to component (b) being 0.0001:1 to 0.6:1.

6. The additive according to claim 5, wherein said graphite-spheroidizing material comprises at least one graphite-spheroidizing element selected from the group consisting of magnesium, rare earth elements and calcium.

7. An additive for use in producing spheroidal graphite cast iron, comprising (a) a fine particle of magnesium oxide having an average particle size of 0.001–10 μm and a purity of 90 weight % or more, and (b) an Fe—Si—Mg, graphite-spheroidizing material, a weight ratio of component (a) to component (b) being 0.0001:1 to 0.6:1.

8. An additive for use in producing spheroidal graphite cast iron comprising (a) a fine particle of magnesium oxide having an average particle size of 0-001–10 μm and a purity of 90 weight % or more, (b) an Fe—Si—Mg, graphite-spheroidizing material, and (c) an inoculant of Fe—Si, Ca—Si and/or Re—Fe—Si, wherein Re is a rare earth element, a weight ratio of (a)/{(b)+(c)} being 0.0001:1 to 0.6:1.

* * * * *